US007294233B2

(12) United States Patent
Banerjee et al.

(10) Patent No.: US 7,294,233 B2
(45) Date of Patent: Nov. 13, 2007

(54) SYSTEM AND METHOD FOR ALTERING THE TACK OF MATERIALS USING AN ELECTROHYDRAULIC DISCHARGE

(75) Inventors: Sujit Banerjee, Marietta, GA (US); Howard Corcoran, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 372 days.

(21) Appl. No.: 10/322,832

(22) Filed: Dec. 18, 2002

(65) Prior Publication Data

US 2003/0089477 A1 May 15, 2003

Related U.S. Application Data

(62) Division of application No. 09/568,361, filed on May 10, 2000, now Pat. No. 6,521,134.

(60) Provisional application No. 60/134,284, filed on May 14, 1999.

(51) Int. Cl.
*D21F 1/64* (2006.01)

(52) U.S. Cl. ..... 162/192; 162/190; 162/189; 162/50; 118/620; 205/689; 205/690; 210/767; 210/777; 204/554; 204/555

(58) Field of Classification Search ..... 427/580, 427/444, 487; 162/272, 192, 198, 199, DIG. 4, 162/190, 189, 50; 204/164, 450, 554, 555; 210/748, 243, 767, 777; 264/121, 120, 126; 118/620; 205/689, 690
See application file for complete search history.

(56) References Cited

U.S. PATENT DOCUMENTS

| | | | | |
|---|---|---|---|---|
| 1,888,419 | A * | 11/1932 | Ainsworth | |
| 4,115,490 | A * | 9/1978 | Munk | 264/438 |
| 4,479,680 | A | 10/1984 | Wesley et al. | 299/14 |
| 5,605,290 | A * | 2/1997 | Brenholdt | 241/21 |
| 5,788,815 | A * | 8/1998 | Norell et al. | 162/190 |

OTHER PUBLICATIONS

D. Willberg et al., "Electrohydraulic Cavitation and Sonolysis," *Environmental Applications of Advanced Oxidation Technologies*, Sep. 1997, EPRI Report CR-107581, pp. 7.1-7.12.

A. Coleman et al., "Acoustic Cavitation Generated by an Extracorporeal Shockwave Lithotripter," *Ultrasound in Medicine and Biology*, 1987, vol. 13, pp. 69-76.

S. Abraham, "Successful Approach in Avoiding Stickies," *Tappi J.*, 1998, vol. 81:2, pp. 79-84.

J. Robinson et al., "Ultraviolet Radiation From Electrical Discharges in Water," *J. Appl. Phys.*, 1973, vol. 44, p. 72-75.

* cited by examiner

*Primary Examiner*—Mark Halpern
(74) *Attorney, Agent, or Firm*—Troutman Sanders LLP; Ryan A. Schneider; James H. Yancey, Jr.

(57) ABSTRACT

A system and method for altering the tack of a material, namely a polymer used as an adhesive, also known as stickies, or pitch. The present invention reduces the tack of the stickies and pitch by exposing the materials for a short duration to low-energy pulsed electrical discharges between a pair of electrodes that are submerged in a liquid medium, such as a fiber stream, water, a pulp slurry, or whitewater.

16 Claims, 6 Drawing Sheets

SYSTEM AND METHOD FOR ALTERING THE TACK OF MATERIALS USING AN ELECTROHYDRAULIC DISCHARGE

CROSS REFERENCE TO RELATED APPLICATIONS

This application is a divisional of application 09/568,361, filed 10 May 2000, now patent U.S. 6,521,134.

This application claims the benefit of U.S. Provisional Application Ser. No. 60/134,284, filed May 14, 1999, which is incorporated herein by reference.

GOVERNMENT INTEREST

This invention was made with Government support under Contract No. DE-FC36-996010381, awarded by the Department of Energy. The Government has certain rights in this Invention.

FIELD OF THE INVENTION

The present invention generally relates to the art of controlling the tack of materials, and more particularly pertains to altering the tack of polymers used as adhesives and pitch.

BACKGROUND OF THE INVENTION

People throughout our society have become increasingly aware and concerned about the environmental issues that plague the world. The depletion of the ozone layer, the rain forests, and clean water are just a few of the environmental issues that are being addressed. One approach in addressing these issues includes preserving resources by recycling them. Consequently, the recycling industry has become instrumental to serving this need.

In the recycling field, one area of increasing interest is the reuse of wastepaper. Millions of tons of wastepaper are generated every year in the United States. Recycling this wastepaper can save countless trees, as well as provide other ecological and economic benefits. However, the key to reuse of this wastepaper is the removal of contaminants from the wastepaper, thereby facilitating the use of recycled or secondary fibers from the wastepaper.

The paper recycling industry encounters a variety of contaminants in wastepaper. Many of these contaminants adhere to paper fibers and therefore may cause problems during the recycling process. One such contaminant is "stickies", which were used originally as paper adhesives or tacky adhesives. Stickies typically are classified as hot melts, pressure-sensitive adhesives (PSAs), latexes, and binders. Pitch is another contaminant associated with both virgin and secondary fibers. Pitch is a part of the extractives from wood, and is released during pulping.

Contaminants may cause operational and product quality problems. Specifically, contaminants may be deposited on wires, felts, press rolls, and drying cylinders of paper machines. In addition, contaminants may hinder bonding of fibers, increase web breaks, and reduce product quality in the papermaking process. Consequently, contaminants must be controlled in order to improve papermaking operations and product quality.

Tack is the sticky property of paper adhesives, paperboard adhesives and glue coating materials. The tack of an adhesive and the adhesive's ability to bond to another surface is dependent, in part, upon the surface energy of the adhesive.

Reducing the tack of contaminants can minimize the propensity of the contaminants to attach to paper machine surfaces, thereby leading to fewer operational problems.

Various prior art methods are used to reduce the tack of the contaminants. Some methods use repulpable or recyclable adhesives. More common methods include chemical additives for modification, detackification, or pacification of the contaminants. For instance, detackification of contaminants is frequently accomplished by adding minerals, such as talc, or surface-active chemicals. These minerals and surface-active chemicals attach to the surface of the contaminants and alter their surface properties, thereby causing tack reduction. This method of tack reduction is described in a publication entitled, "Successful Approach in Avoiding Stickies," by S. Abraham, Tappi J., 81:2 79-84 (1998), which is incorporated herein by reference. Nonetheless, chemical additives can be very expensive and may cause other problems in the papermaking process, such as a decline in product quality.

Mechanical methods for controlling contaminants include dispersion, screening and cleaning. Dispersion is a technique by which contaminants are broken up into smaller and smaller particles until they are invisible in the final product. Unfortunately, the overall appearance of a product may be diminished greatly by the presence of contaminants. In addition, when the product containing contaminants is wound, sticking may occur between adjacent layers.

Screens and centrifugal cleaners are typically used to remove stickies, pitch and debris from the fiber stream. In general, screens are used to physically separate fiber from contaminants based on the differences between the sizes and shapes of contaminants and the holes or slots in the screen. One problem is that screens cannot remove contaminants that are either smaller than the size of the screen hole or deformable enough to pass through the screen hole. Centrifugal cleaners separate contaminants from fiber primarily on differences between the specific gravities of the fiber and the contaminant. However, separation is poor if the specific gravity of the contaminant is similar to the specific gravity of the fiber.

Therefore, there is a need for a system and method for improving the removal efficiency of contaminants, such as stickies and pitch, from a fiber stream. In addition, there is a need for a system and method that can detackify contaminants by altering, without the use of chemicals, the surface properties of the contaminants. There is yet another need for a system and method that alters the tack of materials inexpensively and simply.

SUMMARY OF THE INVENTION

The present invention solves the above-described needs by providing a system and method for altering the tack of a material by the exposing the material to an electrical discharge in a liquid medium.

In one aspect, the present invention provides a method for altering the tack of a material by immersing a material in a liquid medium and introducing an electrical discharge in the liquid medium, wherein the material is exposed to the electrical discharge and the electrical discharge causes a reduction in the tack of the material. The exposure to an electrical discharge or spark can be repeated until the tack of the material is reduced to a desired level of tackiness.

The liquid medium is typically selected from a group consisting of whitewater, water, and a pulp slurry. The material is preferably a polymer used as an adhesive or the material may also be pitch. The polymer is selected from a group consisting of pressure sensitive adhesives, hot melts, latexes, and binders. Stickies or pitch may be suspended alone or attached to a surface of an object, such as a fiber, a metal object, a plastic object, and other machine surfaces. Moreover, the electrical discharge produces energy of about 0.1 to 25 kJ.

In another aspect, a method for reducing the tack of a contaminant in a liquid medium is described. Specifically, a high voltage/high current store of energy is discharged in a liquid medium containing a contaminant, wherein the energy is discharged in a predetermined time period and the energy causes the tack of the contaminant to be reduced.

In addition, multiple high voltage/high current stores of energy can be discharged in the liquid medium containing the contaminant until the tack of the contaminant reaches a desired level. The multiple high voltage/high current stores of energy may discharged from the same energy source or from different energy sources. In the case of multiple stores of energy emanating from different energy sources, the multiple high voltage/high current stores of energy may be discharged either synchronously or asynchronously. The energy is discharged from a sparker.

The predetermined time period preferably ranges from about 5 microseconds to 500 microseconds. The high voltage is preferably in the range of about 500 V to 20,000 V. The high current is preferably in the range of about 10,000 A to 100,000 A.

In another aspect, a system for altering the tack of sticky contaminants in paper machine and pulp recycling operations so as to improve paper product quality in paper-making processes and to reduce operational problems is described comprising: a power supply supplying high current/high voltage electricity to a capacitor bank, where the capacitor bank is connected to the power supply and stores the high current/high voltage electricity supplied by the power supply; a chamber containing a liquid medium with sticky contaminants; and at least one pair of electrodes being submersed in the liquid medium contained in the chamber, where the at least one pair of electrodes is cabled to the capacitor bank and releases in the liquid medium at least one spark of the high current/high voltage electricity stored in the capacitor bank, wherein the sticky contaminants in the liquid medium are exposed to the release of the high current/high voltage electricity from the at least one pair of electrodes, thereby altering the tack of the sticky contaminants.

The release of high current/high voltage electricity produces energy of preferably about 0.1 to 25 kJ. Moreover, the duration of the release of high current/high voltage electricity ranges from preferably about 5 microseconds to 500 microseconds.

These and other objects, features, and advantages of the present invention may be more clearly understood and appreciated from a review of the following detailed description of the disclosed embodiments and by reference to the appended drawings and claims.

DETAILED DESCRIPTION

Polymers used as adhesives, such as stickies, and pitch are commonly found in whitewater and pulp slurries. Consequently, these contaminants due to their sticky property, known as tack, can attach to components of a paper machine, thereby causing operational problems. These contaminants may also reduce product quality when present in a final product produced by the paper machine. Hence, it is desirable to reduce the tack of these materials in the whitewater or pulp slurry to ameliorate the removal of these contaminants from the fiber stream, to eliminate the negative effects they have on product quality when present in the final product, and to reduce operational problems. By doing so, the whitewater or pulp slurry can be efficiently used in the papermaking process.

In general, the present invention provides a system and method for altering the tack of a material, which in turn, improves the removal efficiency of the materials or contaminants from a liquid medium, diminishes the negative effects of tackiness the contaminants may have on the final product, and reduces papermaking operational problems. It has been found by those skilled in the art that a material becomes less tacky by changing the surface energy of the material.

While prior art methods use techniques for altering the tackiness of materials by using chemical additives, the present invention does not require chemicals for this purpose. Specifically, the present invention changes the surface energy of a material by exposing the material for a short duration to low-energy pulsed electrical discharges between a pair of electrodes that are submerged in a liquid medium. The result is a detackified or less tacky material, which improves removability of the contaminant from a liquid medium, such as a fiber stream, and reduces papermaking operational and process problems.

As used herein, the terms "material" and "contaminant" are used interchangeably and specifically refer to polymers and pitch.

Exemplary embodiments of the present invention are described herein below in connection with FIGS. 1-7, wherein like numerals represent like elements among the figures, and the accompanying examples.

Figure 1:
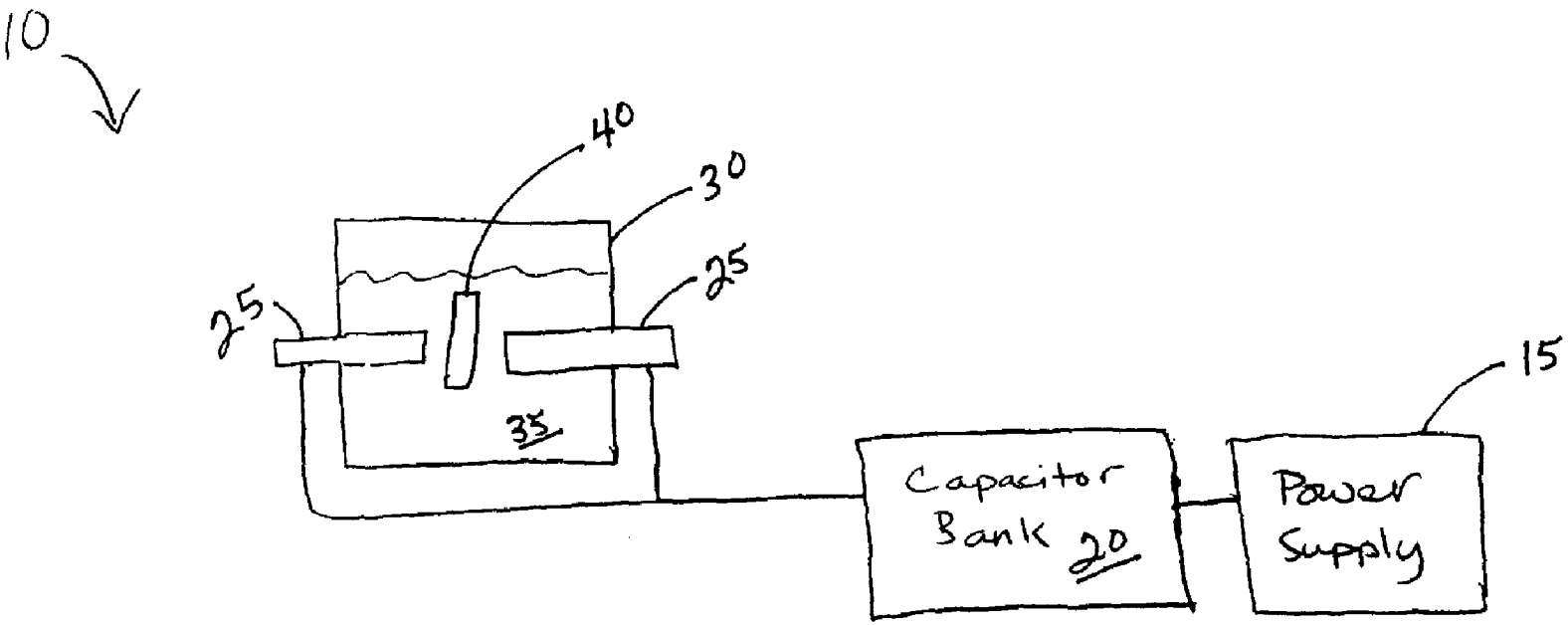
FIG. 1 illustrates a system for reducing the tackiness of a material consistent with an embodiment of the present invention.

Referring to FIG. 1, a system for reducing the tackiness of a material consistent with an embodiment of the present invention is shown. The system 10 includes a chamber 30 for housing a liquid medium, and a sparking device, comprising a power supply 15, a capacitor bank 20, and a pair of electrodes or sparker 25. A sparking device that can be used in the present invention is the Sparktec plasma sparker (SPK-8000), which is manufactured and sold by Sparktec Environmental of Stoney Creek, Ontario, Canada.

Specifically, the pair of submersible electrodes or sparker 25 is cabled to a bank of capacitors housed in the capacitor bank 20. The sparker 25 releases the energy stored by the capacitors and may be placed in the chamber 30 containing a liquid medium 35. Alternatively, the sparker 25 may be positioned in a tank or other container, as shown in connection with FIG. 2, or in pipes through which the liquid medium flows, as shown in connection with FIG. 3. The sparker 25 may include a feeding mechanism (not shown), which ensures that the gap between the electrodes remains constant.

The power supply 15 controls power management and is functionally connected to the capacitor bank 20 for providing a constant current power supply to the capacitor bank 20. The power supply 15 may include a computer interface, which monitors the supply unit, controls the electrode feed mechanism, if present, and times the high voltage/high current discharge pulse generated by the bank of capacitors.

The capacitor bank 20 contains a bank of high voltage discharge capacitors for storing energy. The capacitor bank 20 may include a switch mechanism (not shown), which triggers the release of a high voltage/high current pulse to the sparker 25.

It will be appreciated by those skilled in the art that the present invention may include any suitable power supply capable of controlling power management and converting AC current to high DC voltages. It is further appreciated that the present invention may utilize any pair of electrodes suitable for releasing high voltage/high current energy and capable of being properly secured such that the gap between the electrodes remains constant. For example, a pair of electrodes may be securely clamped or welded to a chamber or an air compressor may be used to ensure that the gap between the electrodes remains constant.

Referring to FIG. 1, the system 10 operates by injecting energy into a liquid medium 35 through a plasma channel formed by a high-current/high-voltage electrical discharge between the two submersed electrodes 25. The system 10 works on the same principle as a spark plug.

Specifically, a high voltage and a high current are impressed between the pair of electrodes 25, also referred to herein as a sparker 25, for a very short duration such that the energy dissipates by sonic/ultrasonic waves (also referred to as shock waves) that break up the water molecules. Consequently, the water molecules closest to the spark break up due in part to the spark itself, while the water molecules at some distance from the spark break up due to the sound waves caused by the spark. The electrohydraulic discharge or spark also produces ultraviolet and other radiation and generates reactive chemical species, such as hydroxyl radicals and other oxidants. As used herein, the terms "electrical discharge" and "electrohydraulic discharge" are used interchangeably, where electrohydraulic discharge means an electrical discharge that takes place in a liquid medium.

In the present invention, the high voltage used is preferably in the range of 500 V to 20,000 V, and more preferably in the range of 2,000 V to 8,000 V. The high current used is preferably in a range of 10,000 A to 100,000 A, and even more preferably about 50,000 A. The duration of the electrical discharge is preferably less than 1 second, and more preferably in the range of 5 microseconds to 500 microseconds, and even more preferably about 150 microseconds.

When the sparker 25 is activated by supplying power from the power supply 15 to the capacitors in the capacitor bank 20, the capacitors are rapidly charged with electricity. At a predetermined interval, a process controlled high voltage/high current switch (not shown) associated with the capacitor bank 20 releases the stored energy from the capacitors to the electrodes 25 located in the chamber 30 containing the liquid medium 35. The high voltage/high current released from the capacitors then bridges the gap at the electrodes 25 causing the spark. Each spark preferably has energies ranging from 0.1 kJ to 25 kJ, and more preferably about 12 kJ.

With continuing reference to FIG. 1, the material 40 to be treated is placed in the liquid medium 35 surrounding the sparker 25, and the sparking device is activated, whereupon the surface energy of the material is altered by the effect of the spark transmitted through the liquid medium 35. In other words, the material 40 is exposed to the electrical discharge from the electrodes 25.

The exposure may be direct, where the contaminant is or almost is in direct contact with the electrical discharge of the sparker 25 due to the close proximity of the contaminant to the sparker 25. Alternatively, the exposure may be indirect since the surface energy of the contaminant can be affected at a distance from the spark.

After exposure to the electrical discharge, the material's surface energy changes, thereby altering the tack of the material. Typically, the surface energy of the material increases after exposure to the electrical discharge. The material is exposed to at least one spark, but can be exposed to multiple sparks. Those skilled in the art will understand that the surface energy of the material may either increase or decrease after exposure to the electrical discharge resulting in an alteration in the tack property.

The liquid medium can be whitewater, a pulp slurry, or other fiber stream, where paper fibers are suspended in the stream and are transported with the flow of the stream. The liquid medium may also be water, which may or may not contain a solution of chemicals, such as chlorite or sodium hypochlorite, or chemicals typically present in whitewater.

The material to be treated is preferably a polymer used as an adhesive, also known as "stickies". As previously described, stickies may be classified as hot melts, latexes, pressure sensitive adhesives (PSAs), and binders. Examples of stickies include, but are not limited to polyacrylate PSAs, polyvinyl acetate (PVAc) and polyurethane. The group of polymers used as adhesives is commonly known by those skilled in the art, and the present invention is not limited in any way as to its applicability to altering the tack of that group of polymers used as adhesives. In addition, the material to be treated may also be pitch, which is a natural component of wood that behaves like stickies and is found in virgin fiber, as well as secondary fiber. These materials, namely stickies and pitch, are oftentimes attached to the surface of an object, such as paper machine components, including felts, wires, press rolls, drying cylinders, and other surfaces of the paper machine. These materials may also attach to fibrous surfaces, including paper, paperboard, and the like.

Figure 2:
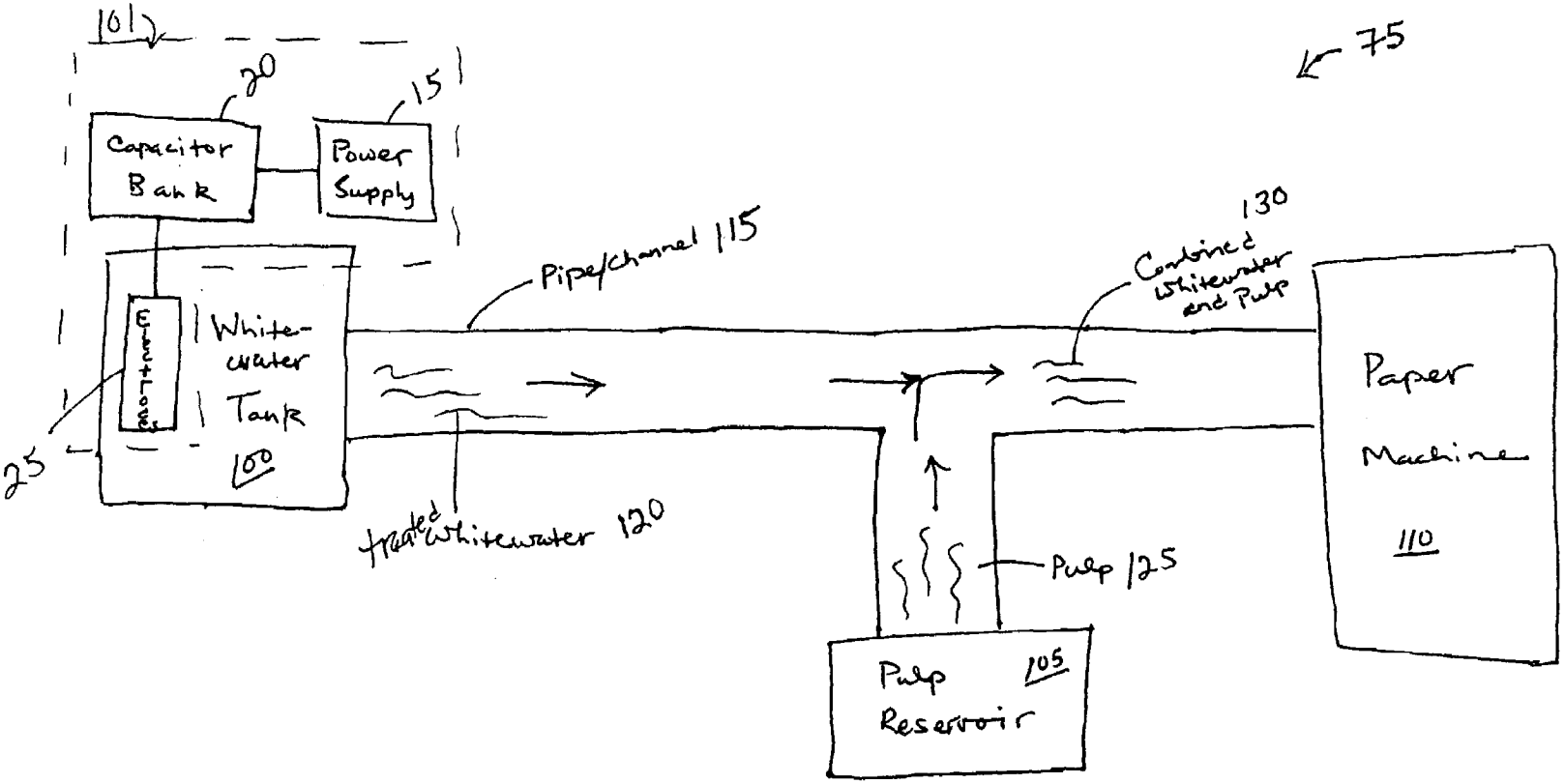
FIG. 2 illustrates an exemplary operating environment consistent with an embodiment of the present invention.
Figure 3:
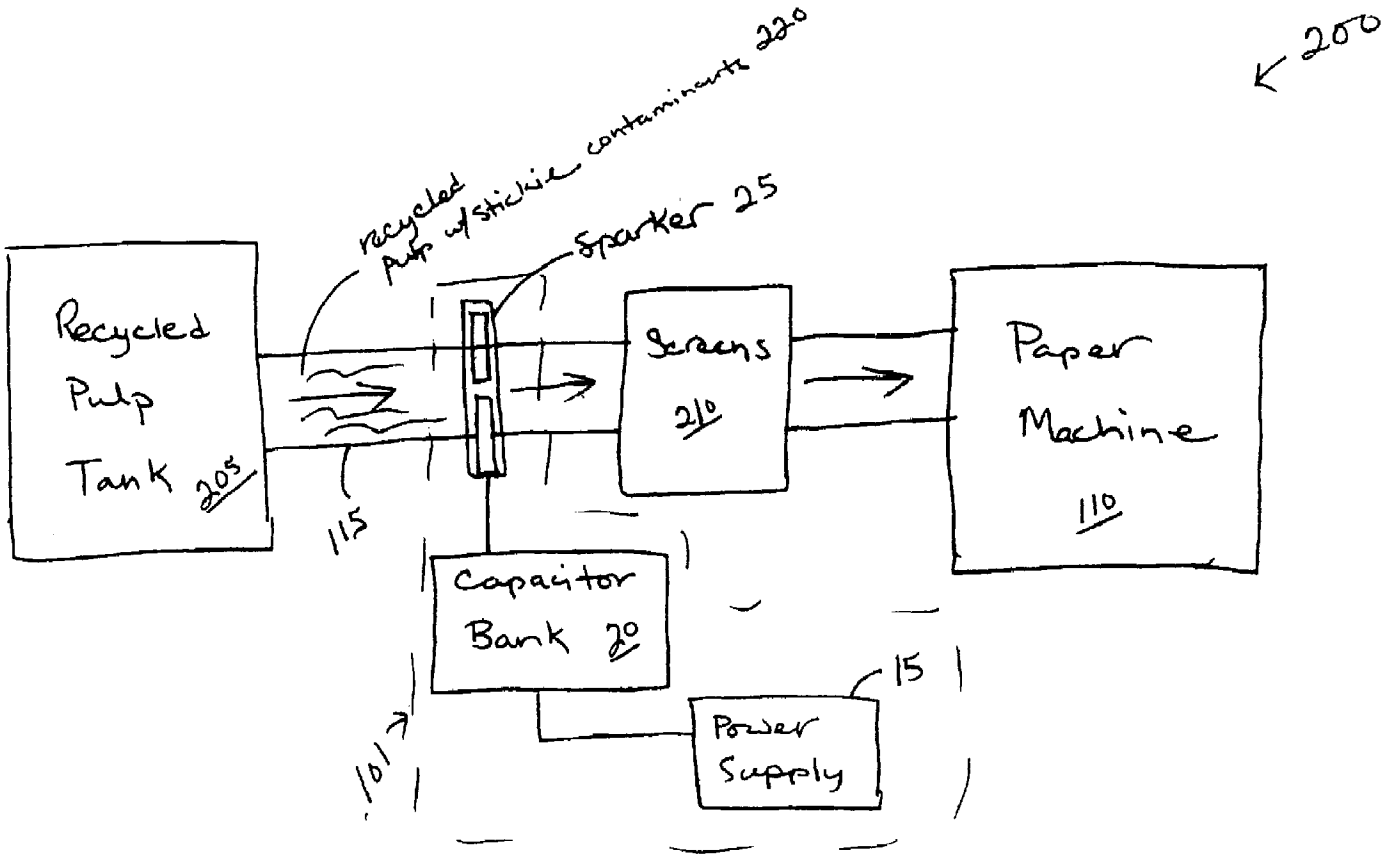
FIG. 3 illustrates another exemplary operating environment consistent with an embodiment of the present invention.

FIGS. 2 and 3 illustrate exemplary operating environments for reducing the tack of contaminants in whitewater and recycled pulp, respectively. As used herein, the term "recycled pulp" refers to a pulp slurry containing contaminants such as stickies, pitch, and/or other solids.

In FIG. 2, the operating environment 75 shows a whitewater tank 100, which contains contaminated whitewater, namely whitewater with stickies and/or pitch. In addition, FIG. 2 shows a sparking device 101 comprising a pair of electrodes 25, a capacitor bank 20, and a power supply 15. The sparking device 101 is positioned such that the electrodes 25 are submerged in the whitewater tank 100. In paper mill and recycling environments, the sparker may have dimensions of about 4 feet high, about 5 inches wide, and about 2.5 inches deep, like the sparker manufactured and sold by Sparktec Environmental of Stoney Creek, Ontario, Canada. Those skilled in the art will understand that the present invention is not limited to the aforementioned sparker, but may integrate a sparker meeting specified parameters in the tank.

In FIG. 2, the contaminated whitewater is repeatedly exposed to the electrical discharges of the sparker 25, as previously described in connection with FIG. 1, while in the whitewater tank 100 until it becomes less tacky. This treated whitewater 120 then flows through the pipe or channel 115 and effectively combines with pulp 125, which flows from a pulp reservoir 105. Next, the combined whitewater and pulp 130 continues its approach flow to the paper machine 110. Advantageously, the present invention reduces operational problems that occur due to sticky contaminants in the papermaking process.

It will be appreciated by one skilled in the art that the sparking device 101 is not limited to placement in the whitewater tank 100, but may be placed anywhere in the system for treatment of the whitewater prior to its approach flow to the paper machine 110.

Referring to FIG. 3, the sparking device 101 is integrated into the pipe or channel 115 in a recycled pulp environment 200. Specifically, the sparking device 101 is positioned and secured between a recycled pulp tank 205 and screens 210. The recycled pulp tank 205 contains recycled pulp 220. As the recycled pulp 220 flows from the recycled pulp tank 205 to the screens 210, the pulp 220 is repeatedly exposed to the electrical discharges of the sparker 25.

As a result of exposure to the electrical discharge or spark, the surface energy of the sticky contaminants in the pulp is altered such that the tack of the stickies is reduced. The treated pulp then flows through the screens 210, which filter out the contaminants, and continues its approach flow to the paper machine. As previously mentioned, this process improves the removal efficiency of contaminants from the fiber stream as is shown in connection with FIGS. 6*a* and 6*b*, which are described in greater detail herein below.

It is preferable that the sparker is positioned as early in the flow process as possible. However, it will be appreciated by one skilled in the art that the sparker 25 may be positioned anywhere in the system as long as the pulp is treated before the pulp flows to the paper machine 110. Moreover, one skilled in the art will understand that direct exposure or contact with the electrical discharge from the electrodes is unnecessary due to the fact that the surface energy of the material may be altered a distance upstream or downstream from the location of the electrical discharge.

The present invention is not limited to the use of one sparker for the treatment of contaminated whitewater, pulp slurries, or other liquid media. Multiple sparkers may be used to reduce the tack of contaminants. The sparkers may discharge at different times or at the same time. The sparkers may be arranged such that each has its own capacitor bank and power supply. Alternatively, the sparkers may share a common capacitor bank and/or power supply. Also, at least one sparker may be placed directly in a tank containing the whitewater, pulp slurry or other liquid media, instead of or in addition to placing the sparker along the pipe or channel through which the liquid medium containing the contaminants flows. As previously described, the present invention is not limited to uses with whitewater and pulp slurries, but may also include other liquid media containing polymers used as adhesives and/or pitch.

Advantageously, the present invention is an inexpensive system and method for altering the tack of materials. The inventive system is simple to implement and provides an economic benefit of reducing the tack of materials without using chemicals, which can be very expensive. However, the inventive system may be used in conjunction with use of conventional chemicals to further improve detackification, while reducing the amount of chemicals typically required for such purposes.

The following examples, which are merely illustrative of the present invention, further demonstrate applications of the present invention in altering the surface energy of a polymer, as well as demonstrate the benefits associated therewith.

EXAMPLE 1

Two 316 stainless steel coupons (5.5 $cm^2$) were coated with 10 mL of an acrylate pressure sensitive adhesive (Carbotac latex from B. F. Goodrich), and dried so that the acrylate formed a thin, tacky surface film. One coupon was submerged in water in a thirty-gallon tank and treated with thirty sparks delivered with the sparking device. The surface energy of the film was measured before and after sparking. Surface energy is a measure of tack. Before treatment by the sparker, the surface energy was 15.7 dy/cm, whereas after treatment by the sparker, the surface energy was 22.9 dy/cm. These results demonstrate a substantial increase in surface energy upon spark treatment, where an increase in surface energy of the film indicates a reduction in tack.

EXAMPLE 2

Stainless steel coupons (5.5 $cm^2$) were coated with 10 mL of an acrylate pressure sensitive adhesive (Carbotac latex from B. F. Goodrich), and dried so that the acrylate formed a thin, tacky, surface film. These coupons were submerged in water in a three-gallon tank, and treated with sparks delivered with the sparking device. The results listed in Table 1 demonstrate that sparking induces an increase in surface energy, and that the tack decreases upon sparking. In this instance, tack is defined as the force required to remove a 1" diameter 305 stainless steel probe from the surface of the film as measured by a commercially available instrument manufactured by Instron of Canton, Mass. One measurement was also made where the stickie was applied to a piece of blotting paper prior to sparking. The surface energy of the stickie film was also elevated, indicating that detackification did not require the stickie to have a hard base, but was also effective when it was deposited on fiber.

TABLE 1

Effect of Sparking on the Surface Energy and Tack of an Acrylate Film

| conditions | sparks | Surface energy (dynes/cm) | tack (psi) |
|---|---|---|---|
| control | 0 | 17.4 | 20.6 |
| sparked in water | 10 | 28.8 | 11.7 |
| sparked in water | 30 | 26.7 | 9.03 |
| sparked in water | 60 | 27 | 9.78 |
| sparked in whitewater | 30 | 29.6 | 6.49 |
| sparked in water in the presence of sodium hypochlorite | 30 | 29.6 | 3.45 |

EXAMPLE 3

Experiments were also conducted in the presence of a small amount of sodium hypochlorite (1.4 g/L) dissolved in the water. In the presence of sodium hypochlorite, the surface energy of the stickie increased to an extent greater than the surface energy increase realized with the same number of sparks in the absence of the sodium hypochlorite. An attendant decrease in tack was also realized. It is speculated that one reason for this outcome is the alteration of sodium hypochlorite by the spark, thereby causing it to dissociate into active species, which then interacted with the polymer.

EXAMPLE 4

Experiments were also conducted where the metal coupon was submerged in paper mill whitewater. The surface energy of the stickie increased to an extent greater than the surface energy increase realized with the same number of sparks in the presence of water alone. An attendant decrease in tack also occurred.

Both the sodium hypochlorite and the whitewater experiment demonstrate that components present in or added to water may induce a degree of detackification additional to that anticipated by sparking in water alone.

EXAMPLE 5

Figure 4:
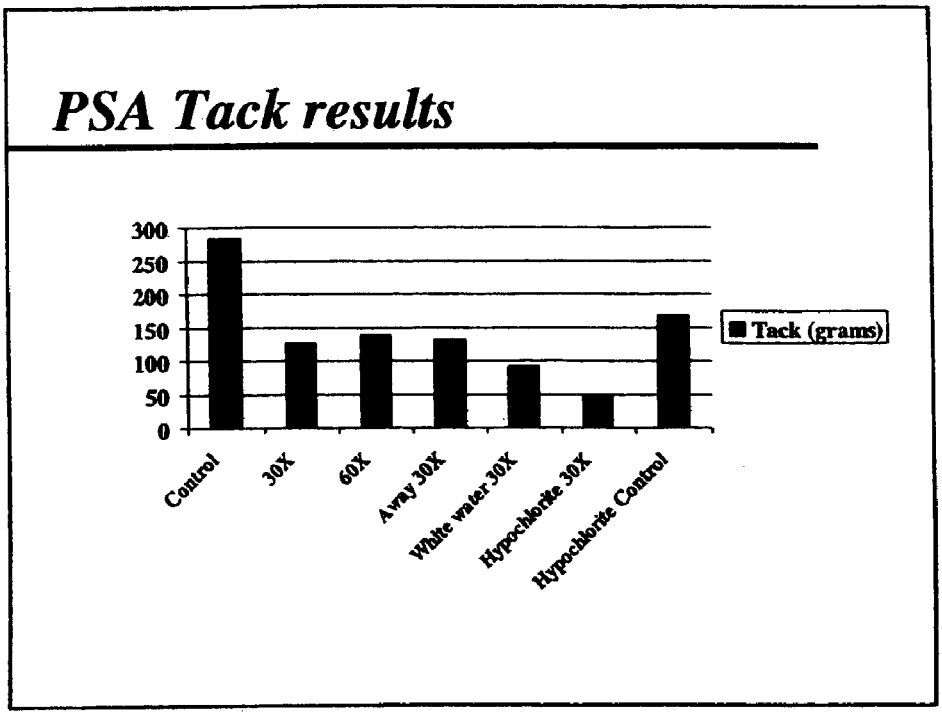
FIG. 4 is a graph illustrating the effects of sparking on tack of stickies under various experimental conditions in accordance with an embodiment of the present invention.

FIG. 4 is a graph illustrating the reductions of tack on PSAs. All PSA samples were polyacrylate films on metal coupons. Samples were sparked in water thirty times, sixty times, both toward the spark, and thirty times turned away from the spark. Each shows similar tack reductions in comparison with a control, which was placed in water, but not sparked. Other samples were sparked thirty times in whitewater from a recycle mill and thirty times in 500-ppm hypochlorite solution in water. Both samples showed decreases in tack compared to the regular water control sample and the hypochlorite control, which was placed in the 500-ppm hypochlorite solution, but not sparked.

EXAMPLE 6

Figure 5:
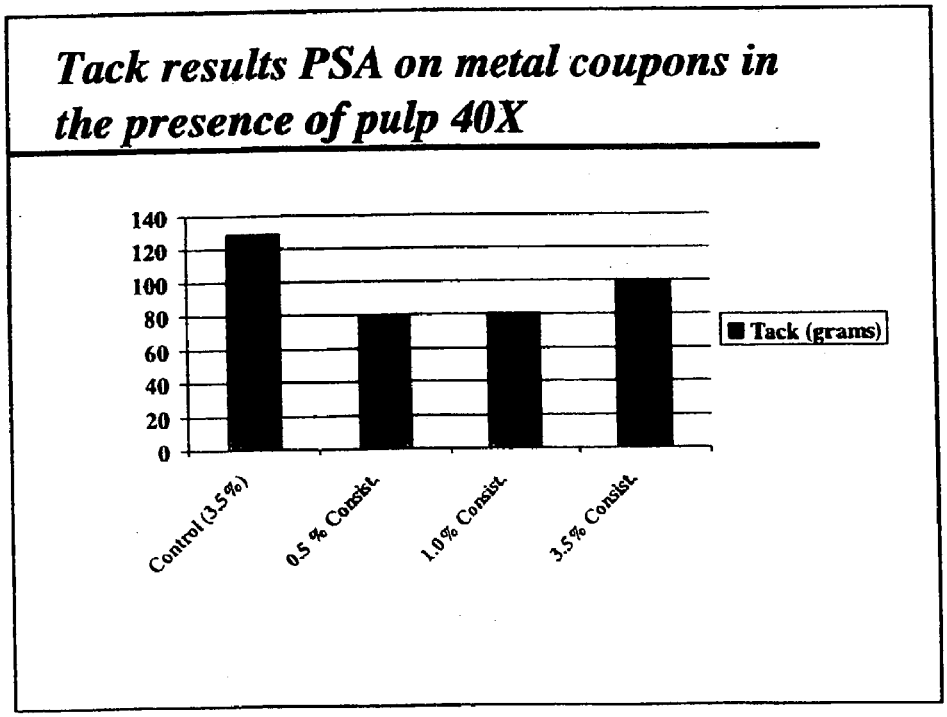
FIG. 5 is a graph illustrating the effects of sparking on tack of stickies under various experimental conditions in accordance with an embodiment of the present invention.

FIG. 5 is a graph illustrating the reductions of tack on PSAs in the presence of bleached Kraft pulp in water at various consistencies. All PSA samples were polyacrylate films on metal coupons. The tack was reduced for PSAs sparked forty times in 0.5, 1.0, and 3.5% consistency pulp (based on fiber/fiber+water) compared to the control which was placed in 3.5% consistency pulp in water, but not sparked.

EXAMPLE 7

Figure 6A:
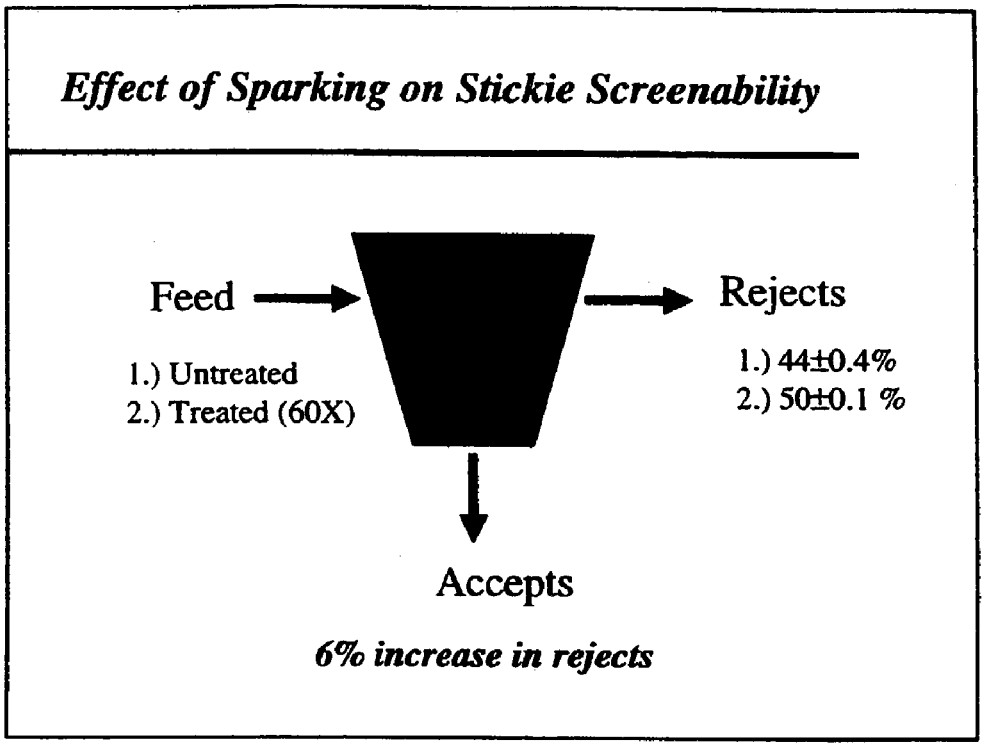
FIGS. 6*a* and 6*b* illustrate the effects of sparking on stickie screenability in accordance with an embodiment of the present invention.
Figure 6B:
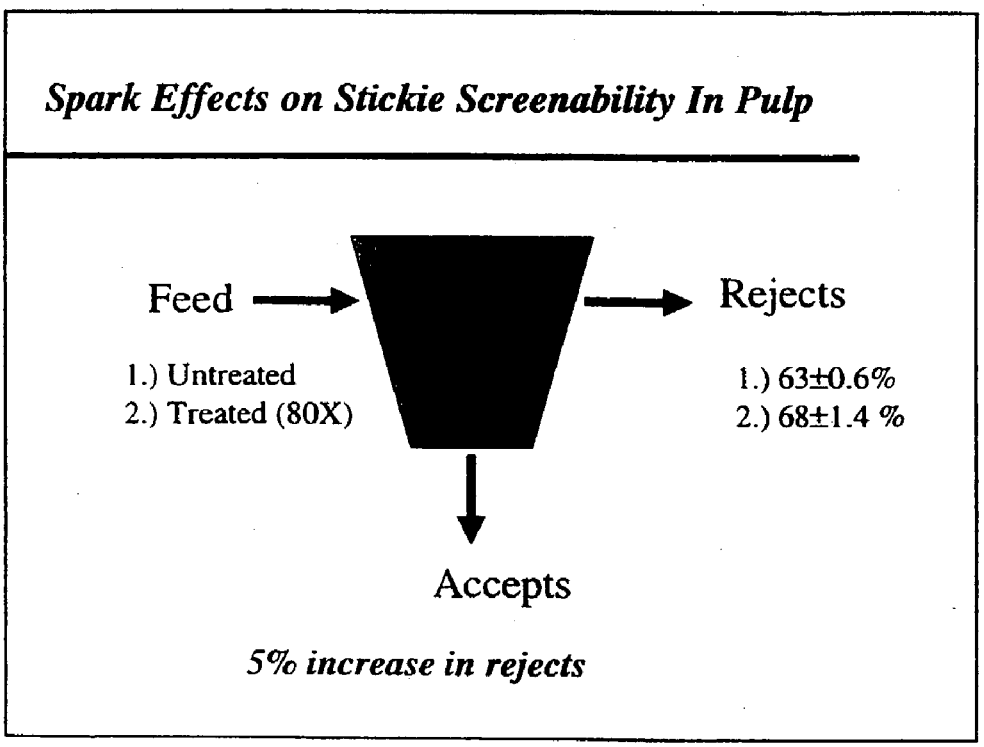

FIGS. 6*a* and 6*b* illustrate the effect of sparking on screenability. PSA in FIG. 6*a* was emulsified in water to a 0.1% consistency (PSA/PSA+water) solution, then the solution was then split into two equal volumes. The reject amount of stickie PSA screened using a 150-micron PULMAC pressure-screening device, which is manufactured and sold by Pulmac of Montpelier, Vt., increased 6% with sixty sparks compared to the control volume, which was screened but not sparked.

PSA in FIG. 6*b* was emulsified in water to a 0.1% consistency (PSA/PSA+water) solution and mixed with bleached Kraft pulp to achieve a 1% pulp consistency. Finally, the stickie-pulp-water solution was then split into two equal volumes. The reject amount of stickie PSA screened using a 150-micron PULMAC pressure-screening device increased 6% with eighty sparks compared to the control volume, which was screened but not sparked.

EXAMPLE 8

Figure 7:
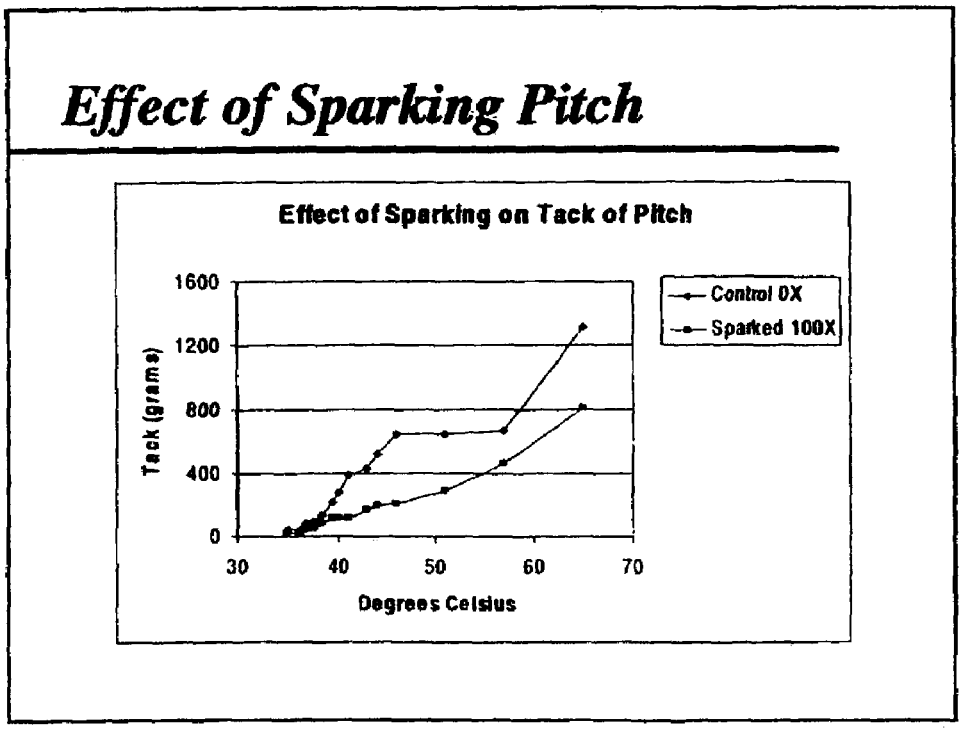
FIG. 7 is a graph illustrating the effect of sparking on tack of pitch in accordance with an embodiment of the present invention.

FIG. 7 is a graph illustrating the effect of sparking on pitch. Pitch films on metal coupons were heated to 100° C. and tested for tack using the Polyken Tack Tester manufactured and sold by Testing Machines Inc., Islandia, N.Y. Tack measurements were taken starting at 65° C. and ending at 35° C. The results show that tack was reduced for the pitch samples that were sparked 100 times compared to the control, which was not sparked.

Alternative embodiments will become apparent to those skilled in the art to which the present invention pertains without departing from its spirit and scope. Accordingly, the scope of the present invention is defined by the appended claims rather than the foregoing description.

What is claimed is:

1. A method for changing a characteristic of a material in a fiber stream, comprising the steps of:

(a) providing a material having a characteristic associated therewith in a fiber stream; and (b) changing said characteristic by introducing an electrical discharge in the fiber stream;

wherein the fiber stream is whitewater;

wherein the step of changing said characteristic by introducing an electrical discharge in the fiber stream comprises the step of changing said characteristic by introducing pulsed electrical discharges in the fiber stream;

wherein the electrical discharges occur in predetermined time periods, and include the discharge of a high voltage/high current store of energy;

wherein the predetermined time periods range from about 5 microseconds to about 500 microseconds;

wherein the high voltage is in the range of about 500 V to about 20,000 V; and wherein the high current is in the range of about 10,000 A to about 100,000 A.

2. The method of claim 1, wherein the characteristic is tack.

3. The method of claim 1, wherein the material is a polymer used as an adhesive.

4. The method of claim 1, wherein the material is attached to a surface of an object.

5. The method of claim 4, wherein the object is a fibrous material.

6. The method of claim 1, wherein the electrical discharge in the fiber stream is from a pair of electrodes.

7. The method of claim 1, wherein the fiber stream is whitewater that has therein fibrous materials.

8. The method of claim 1, wherein the characteristic of the material in the fiber stream is a non-ionic characteristic.

9. A method for changing a characteristic of a material in a fiber stream, comprising the steps of:

(a) providing a material having a characteristic associated therewith in a fiber stream; and (b) changing said characteristic by introducing an electrical discharge in the fiber stream;

wherein the fiber stream is a pulp slurry;

wherein the step of changing said characteristic by introducing an electrical discharge in the fiber stream comprises the step of changing said characteristic by introducing pulsed electrical discharges in the fiber stream;

wherein the electrical discharges occur in predetermined time periods, and include the discharge of a high voltage/high current store of energy;

wherein the predetermined time periods range from about 5 microseconds to about 500 microseconds;

wherein the high voltage is in the range of about 500 V to about 20,000 V; and wherein the high current is in the range of about 10,000 A to about 100,000 A.

10. The method of claim 9, wherein the characteristic is tack.

11. The method of claim 9, wherein the material is a polymer used as an adhesive.

12. The method of claim 9, wherein the material is attached to a surface of an object.

13. The method of claim 12, wherein the object is a fibrous material.

14. The method of claim 9, wherein the electrical discharge in the fiber stream is from a pair of electrodes.

15. The method of claim 9, wherein the fiber stream is a pulp slurry that has therein fibrous materials.

16. The method of claim 9, wherein the characteristic of the material in the fiber stream is a non-ionic characteristic.

* * * * *